US005820173A

United States Patent [19]

Fuller

[11] Patent Number: 5,820,173

[45] Date of Patent: Oct. 13, 1998

[54] LOCK MECHANISM

[76] Inventor: Mark Weston Fuller, P.O. Box 3702, Houston, Tex. 77253

[21] Appl. No.: 762,728

[22] Filed: Dec. 10, 1996

Related U.S. Application Data

[60] Division of Ser. No. 309,843, Sep. 20, 1994, Pat. No. 5,603,534, which is a continuation-in-part of Ser. No. 969, 771, Oct. 30, 1992, abandoned.

[51] Int. Cl.[6] ..... E05C 19/00

[52] U.S. Cl. ..... 292/1; 292/2; 292/333; 292/169.14; 292/DIG. 26; 70/129; 70/487

[58] Field of Search ..... 292/1, 2, 39, 333, 292/335, 34, DIG. 62, 153, 173, 22, 37, 42, 337, 169.13, 169.14, 142, DIG. 21, DIG. 46, DIG. 26, DIG. 24; 70/468, 470, 481, 487, 129

[56] References Cited

U.S. PATENT DOCUMENTS

| | | | |
|---|---|---|---|
| 444,730 | 1/1891 | Shinn | 292/34 |
| 966,208 | 8/1910 | Hoes | 292/DIG. 21 X |
| 1,140,343 | 5/1915 | Arens . | |
| 1,152,776 | 9/1915 | Wolfe et al. | 292/39 X |
| 1,368,141 | 2/1921 | Hagstrom . | |
| 1,516,628 | 11/1924 | Blackwell . | |
| 1,674,760 | 6/1928 | Carroll . | |
| 1,751,101 | 3/1930 | Schlage . | |
| 2,223,050 | 11/1940 | Scragg . | |
| 2,369,873 | 2/1945 | Voight | 292/169.14 |
| 2,672,745 | 3/1954 | Marchetti . | |
| 2,854,270 | 9/1958 | Ward | 292/169.14 |
| 3,201,161 | 8/1965 | Castle . | |
| 3,556,573 | 1/1971 | Miller . | |
| 3,912,310 | 10/1975 | Dugan | 292/169.14 |
| 4,060,267 | 11/1977 | Monfardini . | |
| 4,098,101 | 7/1978 | Svoboda . | |
| 4,113,291 | 9/1978 | Cameron . | |
| 4,199,176 | 4/1980 | Kelly . | |
| 4,227,723 | 10/1980 | Rosell . | |
| 4,231,597 | 11/1980 | Pelcin . | |
| 4,261,602 | 4/1981 | Anderson . | |
| 4,315,647 | 2/1982 | Wilzig . | |
| 4,315,648 | 2/1982 | LaBelle . | |
| 4,387,917 | 6/1983 | Cocker . | |
| 4,489,576 | 12/1984 | Mullich et al. . | |
| 4,512,597 | 4/1985 | Nabb et al. . | |
| 4,601,499 | 7/1986 | Kim . | |
| 4,674,776 | 6/1987 | James . | |
| 4,773,682 | 9/1988 | Saelzer . | |
| 4,815,774 | 3/1989 | Correnti . | |
| 4,844,521 | 7/1989 | Langenbach et al. . | |
| 4,878,699 | 11/1989 | Wronski . | |
| 4,885,922 | 12/1989 | Lutz . | |
| 4,915,430 | 4/1990 | Vitale . | |
| 4,986,576 | 1/1991 | Anderson . | |
| 5,029,909 | 7/1991 | Bunger . | |
| 5,029,912 | 7/1991 | Gotanda . | |
| 5,080,354 | 1/1992 | McDougall . | |
| 5,094,485 | 3/1992 | Lycett . | |
| 5,666,830 | 9/1997 | Litvin | 70/129 |

FOREIGN PATENT DOCUMENTS

| | | | |
|---|---|---|---|
| 735722 | 5/1943 | Germany | 292/169.14 |

OTHER PUBLICATIONS

Triangle Brass Manufacturing Co. brochure on "DUBL--BOLT® No. 3900" (two pages).

TRIMCO Blueprint, Jan. 26, 1988, Rodriquez.

DHL Cataog, p. 18, Oct. 1992.

*Primary Examiner*—Rodney M. Lindsey

*Attorney, Agent, or Firm*—Patterson & Streets, L.L.P.

[57] ABSTRACT

A lock mechanism is provided which may actuate both a deadbolt and flush bolts in response to a single lock movement. The mechanism includes a dual element bolt throw and flush bolt actuator, which locks in place in the extended position if the end of the bolt is pressed inwardly. The throw includes a transfer mechanism which transposes the horizontal movement of the bolt to vertical movement at the flush bolts. The flush bolts also include a mechanism to limit retraction thereof if the extending ends of the flush bolt is exposed to inward directed force. The entire lock mechanism may be actuated by a standard cylindrical lockset having actuating jaws extending therefrom.

10 Claims, 7 Drawing Sheets

LOCK MECHANISM

RELATED APPLICATION

This is a divisional of Ser. No. 08/309,843, filed Sep. 20, 1994, now U.S. Pat. No. 5,603,539 which is a continuation-in-part of Ser. No. 07/969,771, filed Oct. 30, 1992 now abandoned.

BACKGROUND OF THE INVENTION

The present invention is directed to an improvement in locks and locking mechanisms. A flush bolt system for cylindrical lock sets is supplied by the present invention which includes anti-jimmying or anti-forcing features, and an ability to automatically lock several bolts simultaneously.

Doors are used to secure openings through exterior and interior walls, fences or other enclosures. Typically, the door is semi-permanently attached to the wall in a manner which permits the door to be moved with respect to the opening to permit passage there through, and then permit easy and fast repositioning of the door to reclose the opening. This may be accomplished by the use of hinges on one of the stiles of the door, or the door may be located on rollers, or may hang on rollers or be otherwise movable. In each instance, the hinges, or rollers, allow the door to be moved with respect to the opening, while maintaining the door in alignment to reseal the opening.

To secure the opening against undesirable or unwanted entry, the door is provided with a lock. This lock is intended to secure the door to close the opening until the lock is actuated to an unlocked status to allow the door to be moved to an open position. Such locks come in a multitude of forms, and include outside sliding latches, sliding flush mounted bolts, handled latch sets, and keyed locksets. Commonly, many such systems can be utilized in openings having multiple swinging doors to obtain proper securing of the door in the opening.

Double, or french, doors present additional problems for the door designer from the aspect of securing, or locking, the door in position. These doors are hingedly connected to a frame and meet in the middle of the frame opening. Bach is commonly configured to move independently of the other, and they must be sized, and hung in the opening, with clearance therebetween for free movement in the frame but also with insufficient clearance to permit easy jimmying or prying of the doors apart. Further, to securely interlock the doors into the frame a mere bolt therebetween is insufficient. A bolt secured in one door, and extending a short distance into the other door, will not prevent motion of the doors about their hinges. To accomplish this task, an upper, and/or lower, vertical or "flush" bolt is provided which is actuatable out of the top and/or bottom of at least one of the doors and into adjacent frame members. These bolts prevent motion of the door relative to the frame when in the extended or actuated position.

The actuation of flush bolts into the door frame and floor, and accompanying actuation of the deadbolt, presents several problems to the door lock supplier. Most doors are less than three inches in width, and many modern doors are less than two inches wide. For aesthetic purposes, most lock specifiers and secondary market users require that all of the door hardware, except the handles and keyways, fit inside of, or on, the door in such a way as to minimize the exposed parts thereof. Additionally, by keeping exposed parts to a minimum, the ability of thieves or burglars to break the lock and gain entry through the door is minimized. Thus, mainly in industrial, commercial or institutional applications will exterior lock components be acceptable, and then only on the interior side of the door. Therefore, in many instances, the door lock manufacturer must supply a lock and actuation members which physically fit inside the door, leaving only handles and plates exposed. Such an installation commonly includes a lock case containing the lock actuation members, which fits into a pocket extending inward the side of the door, or a lockset, each having a pair of knobs extending from the faces of the door.

In addition to the size limitations on door hardware imposed by the size of the door, designers are faced with increasing government regulation which affects the flexibility of hardware selection common in the past. For example, in most public facilities doors must be wheelchair accessible. In that instance, when french doors are used, they must be operable by a person sitting in a wheelchair. Likewise, to increase security, doors may include mortise locks to further secure them in their frame, in the form of surface or flush mounted locks which are vertically located at the top and bottom of the door. This forecloses the use of manual flush bolts or surface bolts on the door which are disposed adjacent the top of the door, as they are out of reach of the wheel chair bound. Therefore, there exists a need for a retrofitable door lock for use in french doors, which will allow, with the turn of a single handle, the opening of both the top and bottom flush bolts.

In addition to the problems encountered with the design of accessible double door locks, the designer must include anti-theft devices to minimize the ability of thieves or others to bypass the lock and gain entry through the door.

Many doors are fitted with a rotary handle lock, commonly having retracting jaws therein which engage the rear of a bolt. These locks are installed by drilling a hole through the door adjacent the lock stile thereof, and then drilling a cross hole into the lock stile which enters the first hole. The handle lock, with the jaws, is fitted in the first hole with the jaws disposed in alignment with the cross hole, and the bolt is received through the cross hole and engaged with the jaws. Turning of the handle causes the jaws to retract into the handle lock, thus retracting the bolt into the door. As the bolt is biased to a position extending from the door, the bolt head is chamfered so that as the door closes, the chamfered portion engages a strike plate on the doorjamb, and further closing movement of the door causes the bolt to retract inward the door. Where locking is required, the inner knob will typically include a lock tab and the outer knob will include a keyed access. The outer knob is locked against movement by actuating the lock tab in the inner knob to the locked position, thereby preventing turning of the keyed handle. In this position, entry may not be gained by turning the handle to retract the bolt. However, the rotary drive commonly does not include any means of preventing retraction of the jaws which initially actuate the bolt in response to handle movement, and such devices are therefore easily forced. Thus, even where the handle is locked against rotary motion, the bolt may be forced inward the door by exerting inward pressure on the extended portion of the bolt. If further security is required a secondary, keyed, deadbolt can be installed by drilling a second set of holes in the door.

Another lock configuration is the mortise lock. These locks are disposed in a case, and the door must be mortised to receive the case. A hole drilled through the face of the door receives handles received into a mortise case. Mortise locks can include a secondary deadbolt lock therein. External knobs control movement of the latch extending outward through the door butte stile from the case.

SUMMARY OF THE INVENTION

The flush bolt system of the present invention operates in conjunction with a handle, knob or other actuating device which includes a lockout mechanism, such as a "key in knob" or cylindrical lock thereon, which is disposed adjacent a mortised lock component case. The handle, knob or other mechanism actuates a guide member having pinch pulls thereon to move an actuating arm extending out the rear of the case and into engagement with the pinch pulls. This arm actuates a lock bolt disposed in the case in and out of a door-jamb, and simultaneously actuates one or more flush bolts in the door.

The bolt includes a dual, sliding element, latch bolt member which includes a lock bar inserted therethrough configured to engage and lock one of the elements of the latch bolt into position when the latch bolt is extended into the door jamb. The locking element includes a slot into which the bar protrudes. When the latch bolt is fully extended out of the door, the bar end engages the inside of the slot to prevent movement of the locking element inward the door absent motion of the handle or knob. The second element of the dual element latch bolt is a lock bar actuator which is interconnected to the guide member pinch pulls for direct movement with respect to the guide member, and includes a lost motion connection to interconnect to the locking element. The lost motion connection permits each of the individual elements of the dual element latch bolt member to move a slight distance independently of the other. The lock bar actuator further includes a lock bar slot therethrough, through which the lock bar projects. When the guide member is actuated to insert the latch bolt into a door jamb, i.e., to lock the door, the entire bolt moves forward out of the door towards the jamb and the lock bar slot actuates the end of the lock bar into position within the lock bar slot adjacent one end thereof. If the end of the latch bolt projecting outward through the door and into the jamb is pushed inward, the lost motion connection between the parts will allow the locking element to move inward the door slightly, without corresponding movement of the lock bar actuator. This motion causes the end of the slot in the locking element to engage the lock bar, and further inward movement of the locking member, and latch bolt, will not occur. To open the door, the latch bolt is retracted by actuating the handle, knob, or other actuating mechanism to move the guide member inward, thereby pulling the lock bar actuator inward. The slot in the lock bar actuator engages the lock bar along its shank, pulling the end thereof out of the slot in the locking element. The lost motion of the lost motion connection is overcome, and the latch bolt retracts from the door. In the foregoing manner, a lock is provided with a retraction prevention mechanism which is easily usable within the confines of a preexisting lock envelope.

To actuate flush bolts into the upper door jamb and floor, as is sometimes desirable with a pair of doors which meet in the middle such as French doors, or for further security in single door applications, the latch bolt member is provided with a gear rack on the lock bar actuator. This gear rack interconnects to a geared lever, which is gimble mounted to the case and includes a finger extending outward from a central arcuate portion. The geared lever serves to translate the horizontal motion of the latch bolt actuating arm to vertical motion to actuate the flush bolts. The central arcuate portion of the geared lever includes teeth which engage the teeth on the gear rack. As the gear rack actuates back and forth, the arcuate portion of the geared lever rotates, and the finger which radiates therefrom moves up and down. Each of the flush bolts is interconnected to a separate finger through a bolt assembly. Each flush bolt assembly includes a retract detent to maintain the flush bolt system in the retracted position when the door is in an open position, and a bias member to maintain the flush bolt system in the extended position unless the door handle is moved to open the door. Thus, both upper and lower flush bolts, and a latch bolt, may be operated by simply turning a handle.

The lock mechanism, when used in conjunction with a common keyed knob set, is biased to the locked position by the structure of the knobset. Such knobsets are commonly structured such that the retracting jaws thereof are always biased to an extended position, to extend the single piece latch bolt extending therefrom to a frame engaging position, but permitting inward movement of the latch bolt both when the handles are turned or the bolt is pushed inward the door. In the present invention, the flush bolt retract detent maintains the flush bolts, and deadbolt linked thereto, in a retracted position until the detent is actuated manually or by closing the door. Once the flush bolt or latch bolt is actuated, it may only be retracted by turning the knob or handle, and each will not retract fully inward the door in the event inward directed force is placed on the extended portions thereof.

These and various other features and advantages of the invention will be readily apparent to those skilled in the art upon reading the following detailed description and referring to the accompanying drawings.

BRIEF DESCRIPTION OF THE DRAWINGS

For an introduction of the detailed description of the preferred embodiment, reference will now be made to the accompanying drawings, wherein.

BRIEF DESCRIPTION OF THE PREFERRED EMBODIMENT

Figure 1:
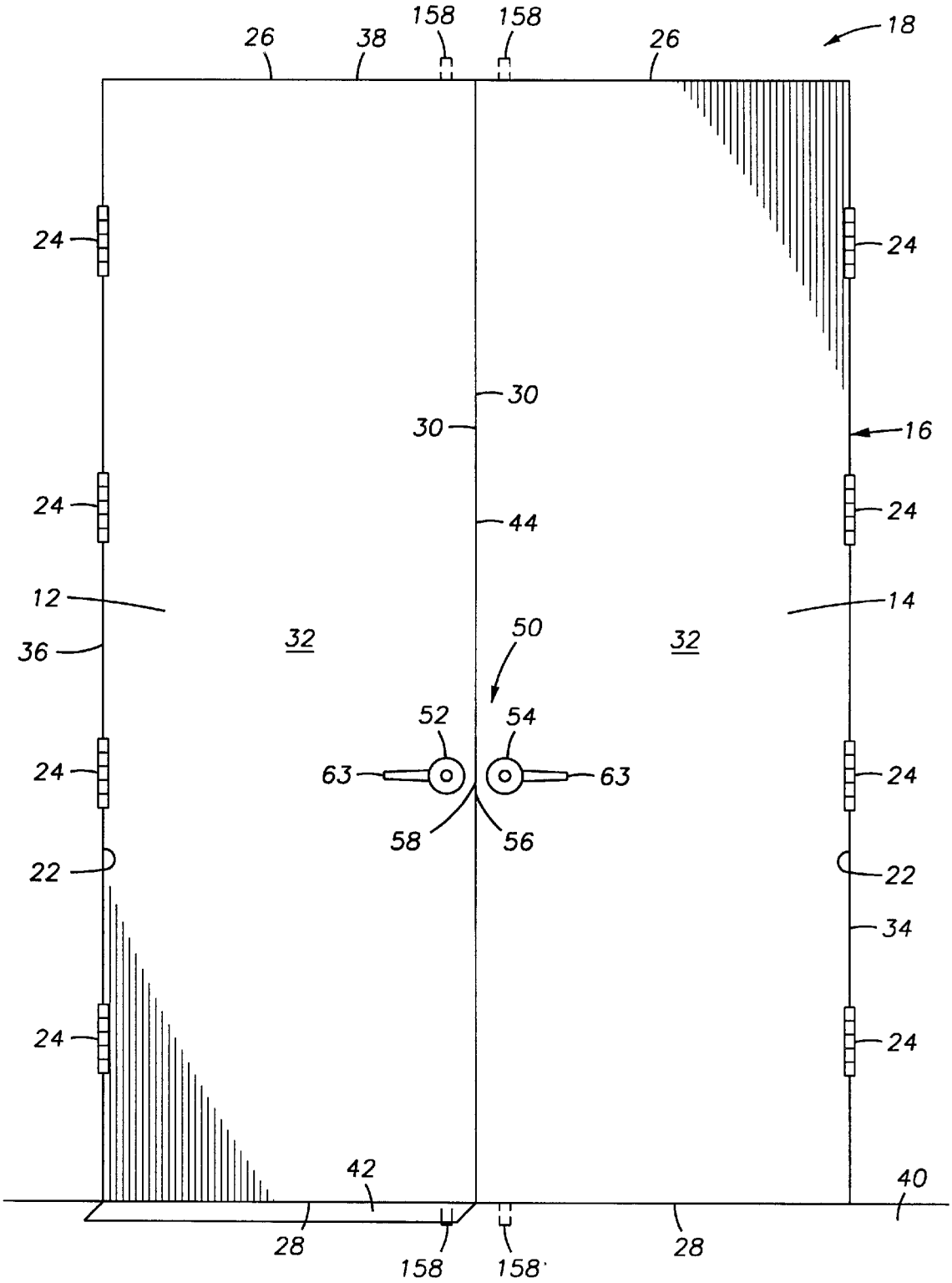
FIG. 1 is a plan view of a pair of doors using the lock mechanism of the present invention.

Referring to FIG. 1, doors 12, 14 are shown pivotally retained within a door frame, or jamb, 16 in wall 18. Each door includes a butte stile 22, attached to the frame 16 by a plurality of hinges 24, upper and lower rail portions 26, 28 extending across the opening enclosed by doors 12 or 14, and a lock stile 30 disposed substantially parallel to the butte stile 22 and supported therefrom by rail portions 26, 28. Although doors 12, 14 are described as solid doors, the invention may be used in conjunction with any door having an area forming a lock stile to receive the lock. Thus, doors 12, 14 may be panel or hollow core doors without panels, or other configurations may be used. In a panel door configuration, one or more panels 32 may be disposed within the area circumscribed by rail portions 26, 28 and stiles 22, 30.

Doors 12, 14 are disposed within frame 16. Frame 16 includes side jambs 34, 36 disposed at opposed ends of an upper rail or header 38, extending downward therefrom at a substantially right angle thereto. Jambs 34, 36 terminate at floor 40, or alternatively, at a door step or sill 42. Jambs 34, 36 are typically anchored to a wall 18, or other structural feature, in which the doors 12, 14 are located. The butte stile 16 of each door 12, 14 includes hinge 24 attached thereto, which is interconnected to the door jambs 34, 36 and thereby frame 16, to secure doors 12, 14 thereto but to permit them to be actuated with respect thereto. Jambs 34, 36, and header 38 may also include a stop thereon (not shown), which is a projecting portion thereon which limits movement of doors 12, 14 such that each door 12, 14 will open only in one direction. Header 38 is sized so that lock stiles 30 align when doors 12, 14 are closed, with a clearance space 44 therebetween. In this configuration, doors 12, 14 are commonly known as french doors. Other door configurations may also be employed without deviating from the scope of the invention. For example, horizontally split two piece doors, commonly known as dutch doors, a single door in a frame, or other configurations may also be employed without deviating from the scope of the invention.

Figure 2:
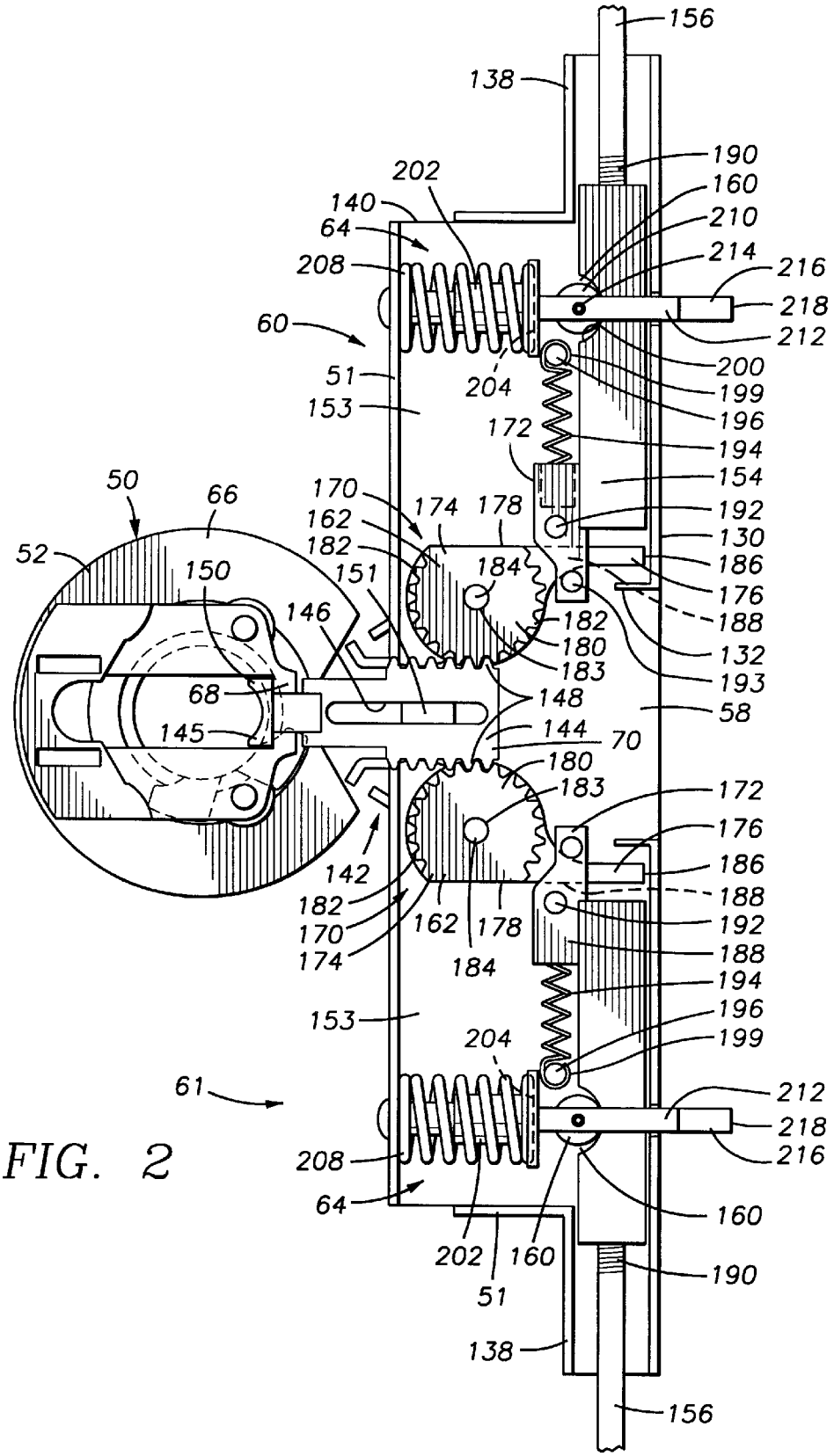
FIG. 2 is a side view of the female lock mechanism of the present invention in a retracted, or unlocked, position.
Figure 3:
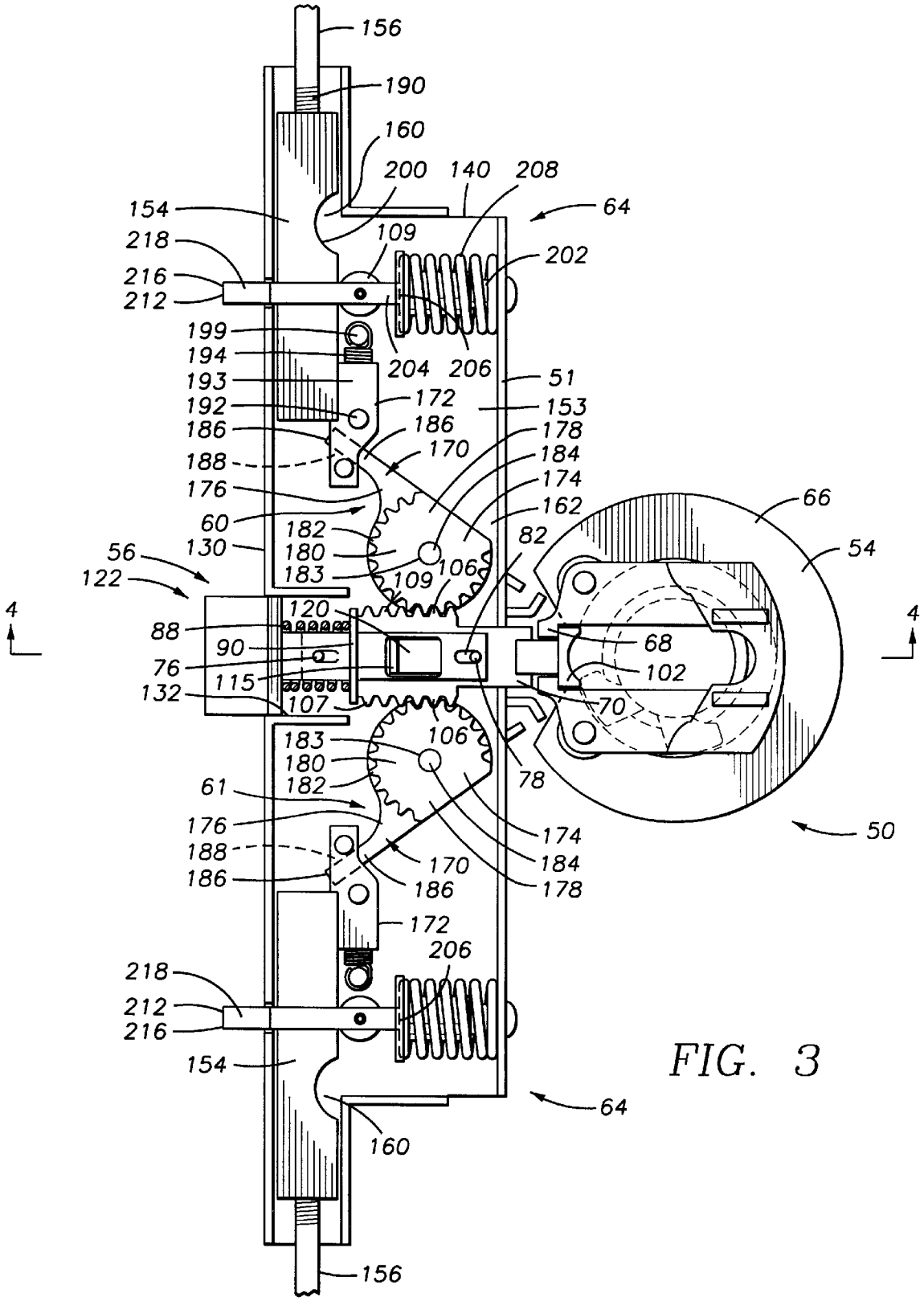
FIG. 3 is a side view of the male lock mechanism of the present invention in a locked position.

To secure doors 12, 14 within frame 16 in the closed position shown in FIG. 1, lock set 50 is provided, which includes first female lock 52 and second, male lock 54 therein. Each of locks 52, 54 include an upper header, or flush bolt 158 and a lower flush bolt 158. A double sided latch bolt 56 (shown in FIG. 3) is included in male lock 54 in door 14. Each of locks 52, 54 are configured to engage into header 38 and floor 40, respectively, and bolt 56 is configured to extend from door 14 and into a latch cutout 58 in door 12. To actuate locks 52, 54 and thereby latch bolt 56 and flush bolts 158, keyed handles 63 are provided on either side of doors 12, 14 and are directly connected to locks 52, 54 as shown in FIGS. 2 and 3. In most situations, only handles 63 on one side of doors 12, 14 include a key way, and the movement of that handle is governed by insertion of a key inward the key way to unlock the handle, while the handle on the opposite side of the door may be moved without the use of a key.

Figure 7:
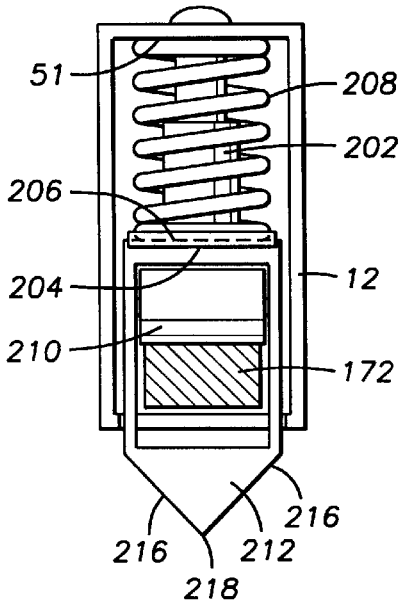
FIG. 7 is a sectional view of a portion of the lock disposed in a door of FIG. 6 at a section 7—7.

Referring now to FIGS. 2, 3 and 7, lockset 50 is shown within doors 12, 14, and includes locks 52 and 54. Each of locks 52, 54 includes a pair of flush bolt throw mechanisms 60, 61 and releasable flush bolt retainer mechanisms 64 mounted within a case 51, which are actuated by a rotary drive member 66 disposed adjacent case 51. Flush bolt throw mechanisms 60, 61 actuate flush bolts 158. Drive member 66 is well known in the art, and translates rotary motion from a knob handle 63, or other input into translational motion to actuate a lock mechanism. One such mechanism is shown and described in U.S. Pat. No. 1,751,101, Schlage, which is fully incorporated herein by reference as if fully set out herein. Drive member 66 also includes a guide member, such as pinch pulls 68 extending therefrom. Pinch pulls 68 serve as a motion transfer mechanism to engage a lock actuating mechanism 70, which actuates flush bolt throw mechanism 60, 61 and thereby double-sided latch bolt 56.

Figure 4:
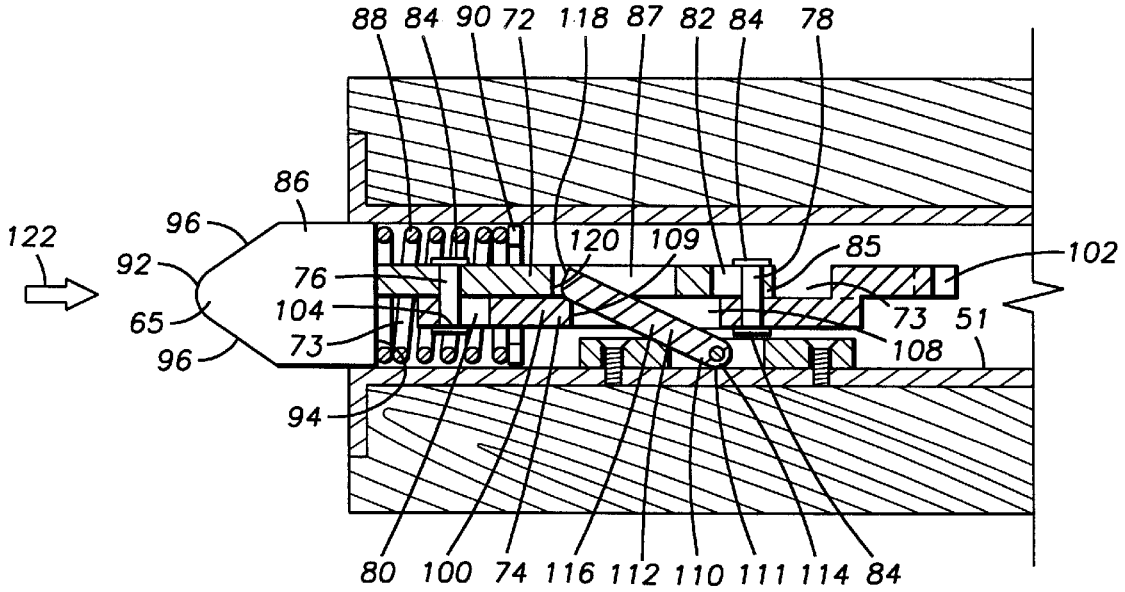
FIG. 4 is a sectional view of the latch bolt of the lock mechanism of FIG. 3 at 4—4.

Referring now to FIGS. 3, 4, and 7 double-sided latch bolt 56 is disposed adjacent rotary drive member 66 and includes a first plate 72 and a second plate 74, interconnected by a pair of pins 76, 78. Each plate further includes a slot portion 80, 82 therein, each of which receive a pin 76 or 78. Pin 76 is rigidly received in first plate 72, and extends into slot 80. Pin 78 is rigidly received within second plate 74, and extends into slot 82. Each pin 76, 78 includes an enlarged head portion 84, which maintains pin 76, 78 in slot portion 80 or 82, and thereby plates 72, 74 in position adjacent each other. Slots 80, 82 are collinear, so that plates 72, 74 may move longitudinally with the long axis of each slot 80, 82.

First plate 72 further includes a first actuated portion 85, an opposed latch portion 86 and an intermediate locking member portion 87 disposed intermediate of latch portion 86 and first actuated portion 85. Latch portion 86 is configured and arranged to actuate out of door 14 to engage into door 12, and includes double-sided latch member 65 biased by a spring 88 which is grounded against a cross bar member 90 on second plate 74. Alternatively, the spring 88 may extend between the double-sided latch member 65 and the lock case. Double-sided latch member 65 is a generally triangular member, having apex 92 extending furthest from spring 88, base 94 which bears upon spring 88, and equilateral-canted sides 96 which extend from apex 92 to base 94. Slot 80, with pin 76 therethrough, is circumscribed by spring 88. Alternatively, the spring 88 may extend between the inner end of the double sided latch member 65 and the case, to bias the bolt member 65 outwardly of the case.

Second plate 74 includes a toothed shank portion 100 bounded at one end in a first engagement portion 102 and at another end in an extending portion 104. Toothed shank portion 100 includes a series of gear teeth 106 along on both upper and lower edges 107, 109 thereof, and a lock bar control slot 108 therethrough. Pin 76 is received in extending portion 104 through slot 80, and slot 82 is disposed in engagement portion 102. As latch bolt member 56 spans the distance between butte stile 22 of door 12 or 14 and rotary drive member 66, and latch bolt 56 is comprised of a pair of plates 72, 74, each having the ability to move with respect to the other, each of the plates 72, 74 is shorter than the span between rotary drive member 66 and the ultimate extended length of bolt member 56. To permit ultimate extension of bolt member 56 and co-commitment retraction thereof, a gap 73 is provided between the end of each of plates 72 or 74 and the adjacent portion of either of plate 72 or 74. This gap 73 is at least as long as slot 80 or 82, and allows actuation of one of plates 72, 74 with respect to the other of plates 72, 74. Thus, pins 76, 78, gaps 73 and slots 80, 82 form a lost motion connection which is actuated during inward directed force of bolt member 56.

To partially control the movement of latch bolt member 56, case 51 includes a pivot 110 having bar 112 disposed therein in a gimble mount 111, such that bar 112 may be pivotally moved about pivot 110. Bar 112 includes a first, gimble receiving portion 114 arcuately secured within pivot 110, an extending portion 116 extending outward therefrom and a locking end portion 118 forming the terminus of bar 112. Bar 112 and pivot 110 are disposed adjacent lockout bar control slot 108 and intermediate locking portion 87, such that extending portion 116 is received therein. Intermediate locking portion 87 is configured as an aperture.

Figure 5:
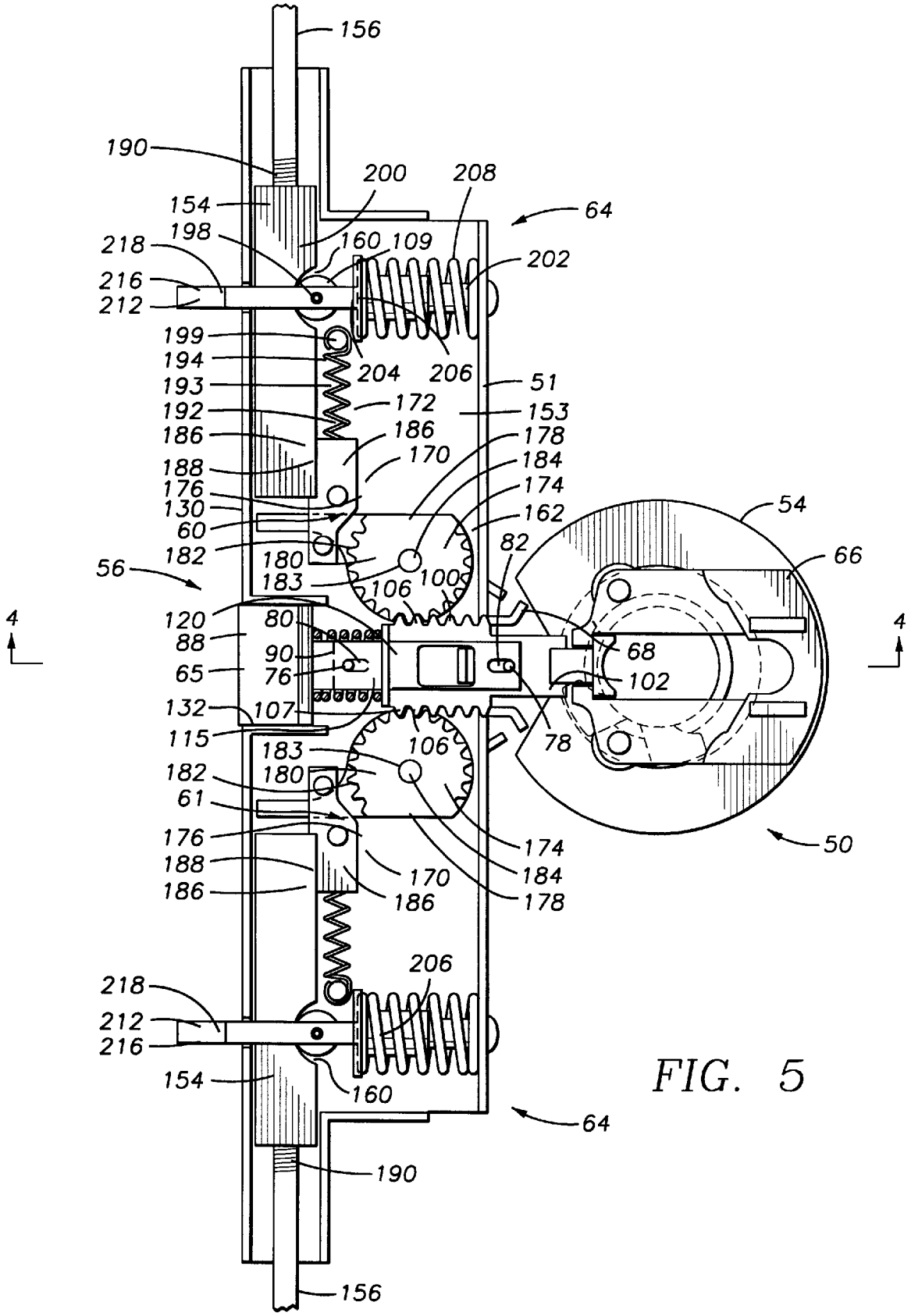
FIG. 5 is a side view of the male lock mechanism of FIG. 3 actuated to the open, or unlocked, position.

Referring now to FIGS. 3, 4, and 5, the interaction of bar 112 and latch bolt member 56 is shown. In FIGS. 3 and 4, latch bolt member 56 is shown in the actuated, or locked position, wherein opposed latch portion 86 thereof is actuated outward beyond the edge of door 14 such that double sided latch member 65 may be received within door 12 or otherwise secure door 14 in a locked position. In FIG. 5, latch bolt member 56 is shown retracted into door 14 such that double sided latch member 65 does not extend outward beyond lock stile 30, to allow the door to move about hinges 16 (FIG. 1) without interfering with the adjacent door 12.

When latch bolt member 56 is in the position shown in FIGS. 3 and 4 with double-sided latch member 65 thereof extending outward beyond lock stile 30, extending portion 116 of bar 112 extends through lockout bar control slot 108 and locking end portion 118 terminates within the aperture formed by intermediate locking portion 87. This aperture is generally rectangular, and the end thereof closest double-sided latch portion 65 is a generally flat end 120 configured to receive locking end portion 118 there against. In this position, inward pressure exerted on double-sided latch member 65 (shown generally at arrow 122) will push end 120 against locking end portion 118. However, as double-sided latch member 65 is free to move relative to plate 74 within the length of the lost motion slots 80, 82 and gap 73, force 122 will not cause movement of plate member 74, and therefore bar 112 will lock in place with locking end portion 118 engaged against end 120, thereby preventing force 122 from causing latch bolt member 56 to retract inward door 14.

To retract latch bolt member 56, handle 63 is turned, causing rotary drive member 66 to actuate the pinch pulls 68 to engage over extending portion 102, which thereby actuates both plates 72, 74 to pull latch bolt 56 inward door 14. As plate 74 is actuated inward door, the edge 109 of lockout lever control slot 108 on plate 74 engages extending portion 116 of bar 112, causing it to arcuately actuate about pivot 110. Such movement moves locking end portion 118 out of engagement with end 120 of intermediate locking portion 87 of plate 72, thereby permitting inward movement of both plates 72, 74 and thus of latch bolt member 56.

To interconnect door 12 and door 14 within frame 16, door 12 includes a strike plate 130 mounted on lock stile 30. Strike plate 130 includes a bolt aperture 132 therethrough into which double-sided latch member 65 from door 14 is received (best shown in FIG. 6).

Referring now to FIGS. 2, 3, 6, and 7, the receipt of double-sided latch member 65 into bolt aperture 132 will not secure a pair of doors 12, 14 against movement in frame 16. Therefore, each of doors 12, 14 further include upper and lower flush bolt drive mechanisms 60, 61 to actuate flush bolts 158 to lock doors securely within upper header 38 and floor 40. The actuation of each of flush bolts drive mechanisms 60, 61, within each of doors 12, 14 is substantially identical, and therefore the operation of one of said drive mechanisms 60, 61 in one of said doors 12, 14 will be described, it being understood that each of the other three in doors 12, 14 operate in substantially the same way.

Figure 6:
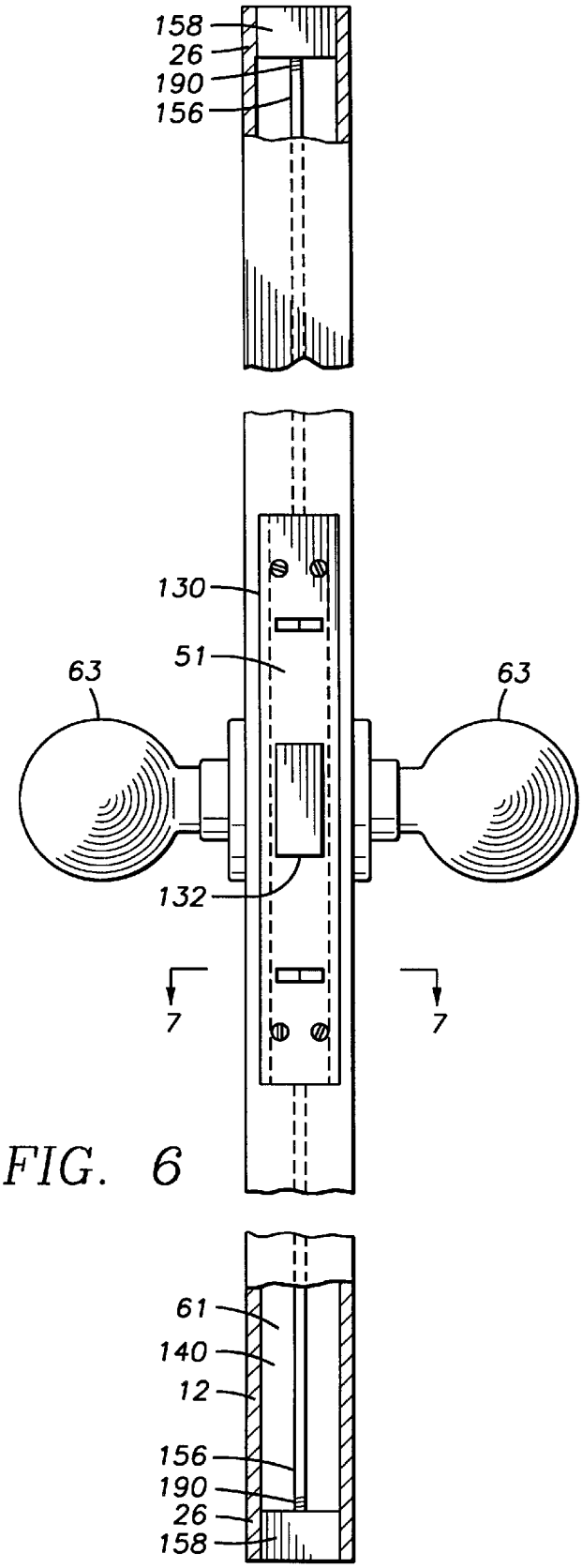
FIG. 6 is an end view of a door of FIG. 1 partially in cutaway moved to the open position showing the arrangement of the lock of the present invention therein.

Referring to FIGS. 2 and 6, upper and lower flush bolt drive mechanisms 60, 61 are secured within a hollow cutout portion 140 in door 12 which extends the length of door 12 and terminates adjacent upper portion 26 and lower rail portion 28. Hollow cutout portion 140 receives both upper and lower flush bolt drive mechanisms 60, 61 and case 51 in which a lock actuating portion 142 is disposed and which actuates flush bolt drive mechanisms 60, 61 as hereinafter described. Case 51 is received in a portion of hollow cutout portion 140, and also includes the latch bolt 56 in the "male" side of the pair of doors 12, 14.

Referring again to FIG. 2, lock actuating portion 142 is comprised of plate 144, having a guide slot 146 therein, gear racks 148 disposed on either side thereof, and a lock attachment portion 150 forming one end thereof. Lock attachment portion 150 of plate 144 extends outward case 51 and is received within rotary drive member 66 of lock 52 on door 12. Lock attachment portion 150 includes outward projecting ears 145 which are received within pinch pulls 68 of lock 52. When lock 52 is actuated to lock or unlock door 12, pinch pulls 68 engage ears 145 to horizontally actuate plate 144 within case 51. To maintain plate 144 in alignment within case 51, a raised guide ledge 151 is provided in case 51, and projects from the side wall 153 thereof. The length of slot 146, less the length of guide ledge 151, is preferably slightly greater than one half inch, to allow horizontal actuation of plate 144 of approximately one-half inch. As door 12, in which the structure of flush bolt 60 is described, does not include latch bolt 56, plate 144 is used in the "female" lock of the pair and is substantially identical to plate 74, except guide slot 146 therein replaces intermediate locking portion 87. Thus, the gear racks 148 on plate 144 are intended to be identical to the gear teeth 106 on plate 74, and plate 144, and the combination of plates 72, 74, may be interchanged such that latch bolt member 56 extends from door 12 into door 14, and door 14 includes only flush bolts 158, if desired.

Referring now to FIGS. 2, 3, and 6, flush bolt drive mechanism 60 includes lock driven member 154 in which transfer rod 156 is received, flush bolt 158 received on the end of rod 156 adjacent upper rail portion 26, lockout mechanism 160 and translation member 162. Flush bolt 158 is configured to be received within upper rail portion 26, and actuate therefrom into frame upper rail 38. Likewise, flush bolt 158 on flush bolt drive mechanism 61 actuates from lower rail portion 28 into floor 40 (or sill 42). Lockout mechanism 160 is configured to retain flush bolt 158 in door 12 when door 12 is in an open position relative to frame 16, and to release flush bolt 158 when door 12 is closed into frame 16 with door 14.

Translation member 162 includes translation arm 170 rotatably retained on case 51 side 153, and lost motion mortise guide 172. Translation arm 170 is preferably a thin metal stamping, casting or the like, having a first semi-arcuate portion 174 and a second, extending finger portion 176 extending from the semi-arcuate portion 174 and terminating within mortise guide 172. Semi-arcuate portion 174 and finger portion 176 have a common base 178, and semi-arcuate portion 174 is formed of a semi-circular extension 180 on one end of translation arm 170. The outer periphery of extension 180 includes a series of teeth 182 thereon, such that extension 180 forms a geared semi-pinion which is received on the gear rack 148 on plate 144. (Where plate 144 is replaced with latch bolt 56, teeth 182 on extension 180 are received on gear teeth 106). Semi-arcuate portion 174 further includes guide hole 183 therethrough, at the center of the radial arc defining the semi-circular extension 180 on which the gear teeth 182 are provided. A guide pin 184 projects from case side 153, and is received within hole 183 to maintain translation arm 170 in position within case 51, but allow rotational motion with respect thereto. Gear rack 148, teeth 182, semi-circular extension 180, and hole 183 and pin 184 are sized to permit relatively free, non-binding movement of translation member 170 about pin 184 in response to lateral motion of plate 144 within case 51.

Extending finger portion 176, which extends from semi-circular extension 180, includes lock end 186 received within mortise guide 172. Mortise guide 172 includes guide slot 188 therein to receive end 186 therein. When flush bolt 158 is in the retracted position shown in FIG. 2, finger portion 176 extends through guide slot 188 and lock end 186 thus extends outward therefrom. When flush bolt 158 is extended into the locked position as shown in FIG. 3, lock end 186 of finger portion 176 terminates within slot 188.

To retract flush bolt 158 from the position shown in door 14 in FIG. 3 to that shown in FIG. 2 in door 12, and thus out of frame 16, rotary drive member 66 is turned, causing pinch pulls 68 to engage ears 146 on lock attachment portion 150 of plate 144, which pulls plate 144 inward door 12. In door 14, first engagement portion 102 is engaged by pinch pulls 68 to actuate bolt 65 inward door 14. As plate 144 moves inward, gear rack 148 engages gear teeth 182 on semi-circular extending portion 180, thereby causing translation arm 170 to rotate about pin 184. Rotation of translation arm 170 causes translational motion of finger portion 176. This translational motion of finger portion 176 causes mortise guide 172 to move vertically as arm 170 moves against the boundary of the slot 188, pulling mortise guide from the extended position until lock end 186 is extended through and within mortise guide 172. Translation arm 170 is sized such that the total vertical movement of mortise guide 172, as a result of arm 170 movement, is at least one and one-half times the length of movement of plate 144.

Referring still to FIGS. 2, 3, and 6, the movement of mortise guide 172 causes equal motion of lockout mechanism 160, which in turn causes equal movement of rod 156 and flush bolt 158 attached thereto. Each of flush bolt 158, rod 156, lockout member 160 and mortise guide 172 are rigidly interconnected, so that motion or force imparted vertically on any member is transferred to each other member. Rod 156 has threaded end portions 190 which are received in threaded holes (not shown) in flush bolt 158 and/or lockout member 160. By turning rod 156, fine adjustment of flush bolt 158, relative to the header 38, may be made.

Lower and upper flush bolt drive mechanisms 60, 61 are spring biased to the thrown, or flush bolt 158 extended, position. To create this bias, mortise guide 172 includes a spring retainer aperture 192, into which one end 193 of a tension spring 194 is hooked, or otherwise retained. The opposite end 199 of spring 194 is affixed to case 51 through a post 196 extending from case side 153. Spring 194, and the distance from post 196 to the fully extended and retracted positions of mortise guide 172, are sized so that spring 194 is in slight tension when flush bolt 158 is fully extended, and in full tension when flush bolt 158 is fully retracted. Spring 194 must thus be sized so that in its fully expanded position, the elastic limit of the spring 194 is not reached. As spring 194 is always in tension, it will maintain a force on flush bolt drive mechanisms 60, 61 tending to actuate flush bolt 158 to its extended position.

To prevent flush bolt 158 from actuating outward when doors 12, 14 are in an open position, lockout member 160 includes an arcuate bumper recess 200 therein, into which retract lockout member 198 is selectively received. Retract lockout member includes a spring-loaded finger having a stationary post 202 affixed to the case 51, over which an annular spring-loaded drive member, or cup, 204 is disposed. Drive member 204 is in the form of an inverted cup, the hollow of which receives post 202. A compression spring 208 is disposed over post, and one end thereof bears on the side case 51 and the other end thereof bears on the annular lip portion 206 of cup 204 surrounding post. In this manner, cup 204 is biased outward from the rear or side of case 51.

To engage and selectively retain lock member 160, cup 204 includes a bumper arm 212 which extends from an edge of cup, encompassing lockout member 160, and terminates outward lock stile 30 of door 12. A circular bumper 210, configured to be received within recess 200, is rotatably secured at its center 214 to arm 212.

Referring now to FIGS. 2, 3, 5 and 7, the portion of bumper arm 212, which extends outward door 12 is triangularly configured, and includes opposed canted sides 216 meeting at peak 218. As door 12 is closed against either of sides 216, further movement of doors 12, 14 into alignment causes the edge of door 14 to push arm 212 inward door 12, thus releasing bumper 210 from recess 200. As flush bolt drive mechanisms 60, 61 are spring-biased, movement of bumper 210 out of recess 200 allows lockout member 160 and flush bolt 158 attached thereto to actuate outward to lock door 12 in jamb 16. When rotary drive member 66 is actuated to retract flush bolt 158, bumper 210 is actuated back into recess 200 by spring 208. Likewise, movement of doors 12, 14 into a closed position actuate arms 212 on door 14, thus extending flush bolts 158.

Referring to FIG. 3, motion of flush bolts 158 in response to inward movement of arm 212 will cause translation member 162 to rotate about pin 184, thus engaging teeth 182 on gear teeth 106 on plate 74, actuating latch bolt 56 into the extended position. Thus both the flush bolts 158 and latch bolt 56 may be actuated into the extended position by closing doors 12, 14 to actuate bumper arm 212. When bolts 56, 158 are in the retracted position, handles 63 will freely turn without corresponding motion of pinch pulls 68. Thus, bolts 56, 158 may only be actuated by depressing finger 212.

Referring now to FIG. 3, with flush bolts 158 in the extended position, inward force or movement on either flush bolt 158 will push the edge of guide slot 188 in the corresponding mortise guide 172 into engagement against lock end 186 of extending finger portion 176, thus preventing further inward movement of flush bolt 158 by outer force. Mortise guide 172, arm 170, rod 156, flush bolt 158, and lockout member 160 are sized such that lock end 186 will engage the end of guide slot 188, as flush bolt 158 is being pushed inward, while a substantial length of flush bolt 158 extends outward door 12, 14. Thus, the interaction of extending finger portion 176 and mortise guide 172 will help prevent forcing of the door by jimmying of flush bolts 158 inward door.

Figure 8:
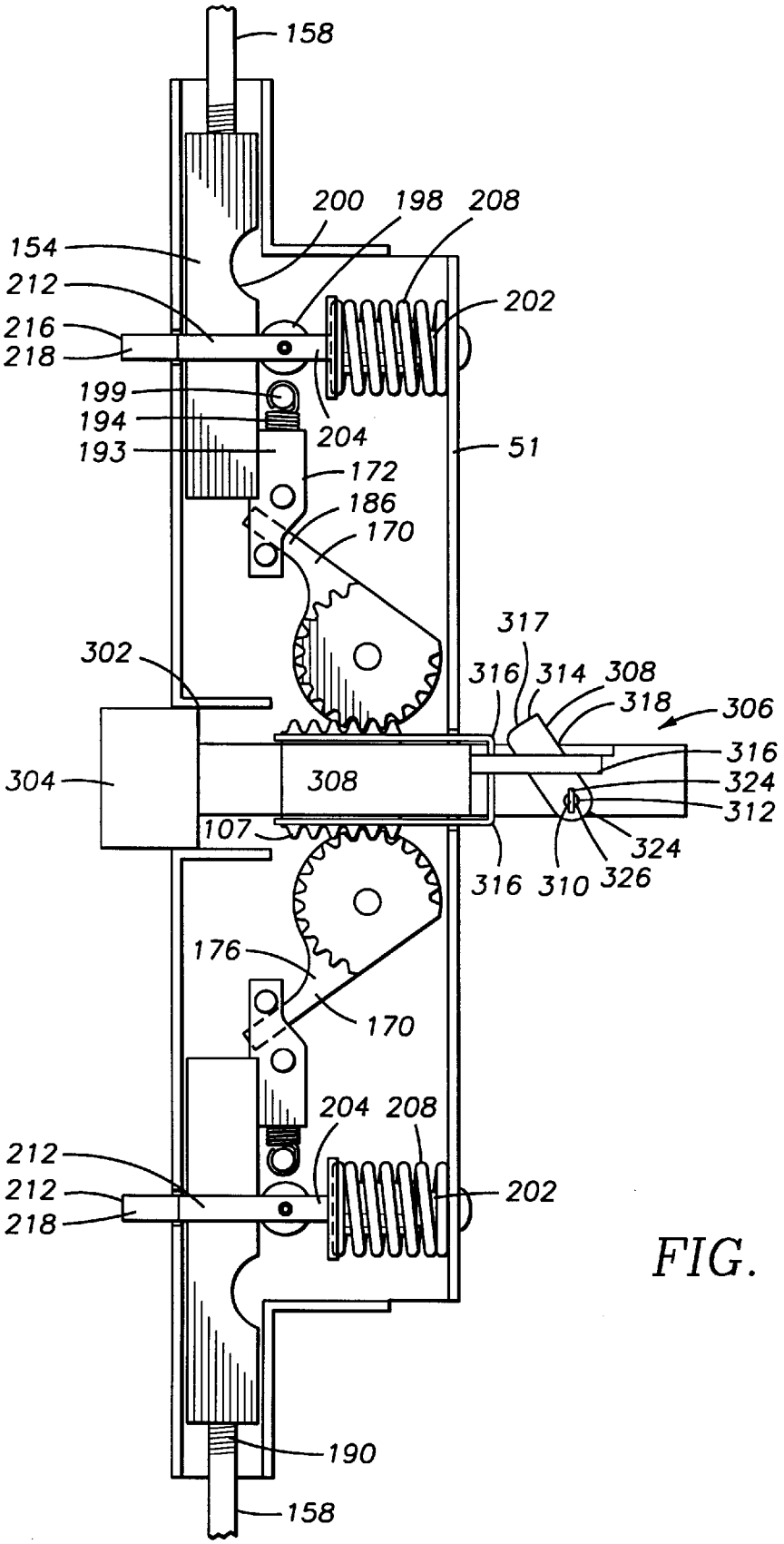
FIG. 8 is a side view of an alternative lock mechanism.

Referring now to FIG. 8, an alternative embodiment of the invention is shown, wherein the rotary lock is replaced with a standard deadbolt lock mechanism 300, modified to actuate flush bolts 158. Deadbolt lock mechanism 300 includes case 302 having lock retainer portion for receiving a deadbolt 304, and an actuating portion 306. Actuating portion includes a lever 308, pivotable about lock tab lead 310, having a first driven portion 312 rotatably received within lock tab lead 310, and a second actuating and locking portion 314 extending therefrom and terminating in a generally flat face 317. Lever 308 may be actuated between a first, engaged position and a second retracted position, by arcuate movement with respect to lock tab lead 310.

Deadbolt 304 includes a rearward projecting slide bar 316, including a slot 318 therethrough into which locking portion 314 of lever 308 extends. A rack member 320 is interconnected to slide bar 316, and includes lower and upper gear racks 322 rigidly interconnected to slide bar 316 to move laterally in conjunction therewith.

First driven portion 312 includes a pair of opposed slots 324 therein, which receive the drive tab 326 of a standard lock cylinder. The lock cylinder may be part of a double cylinder lock, i.e. where a keyed cylinder is disposed on either side of the door, or a single cylinder lock, where a keyed cylinder is disposed on the outer side of the door and a thumb turn is disposed on the interior of the door. Likewise, in certain situations, the lock may not employ keyed cylinders, and other drive systems, including ones having a latch bolt driver on one side of the door only, may be used.

To actuate deadbolt 304, the lock cylinder is turned causing rotation of drive tab 326, thereby actuating locking portion 314 of lever 308 in slot 318. Lever 308 engages the end of slot 318, causing slide bar 316 and bolt 304 to move laterally. Lever 308 is spring loaded, or biased, to drive it from a center or straight up position to either side. Motion of slide bar 316 causes equal motion of gear racks 322, which in turn actuate flush bolts 158 as herein before described.

When deadbolt 304 is fully extended, face 317 of locking portion 314 engages the end of slot 318, preventing retraction thereof unless lever 308 is actuated, thereby limiting the ability to force the deadbolt 304 inward the door 12.

Standard deadbolt mechanism 300 is an off the shelf item, and the only modification thereto is the addition of the rack member 320 with gear racks 322. When this mechanism is employed, the fingers 212 associated with the flush bolts 158 should not be used, as lever 308 would prevent movement of deadbolt 304 and slide bar 316 unless lever 308 is moved from its locked position.

Figure 9:
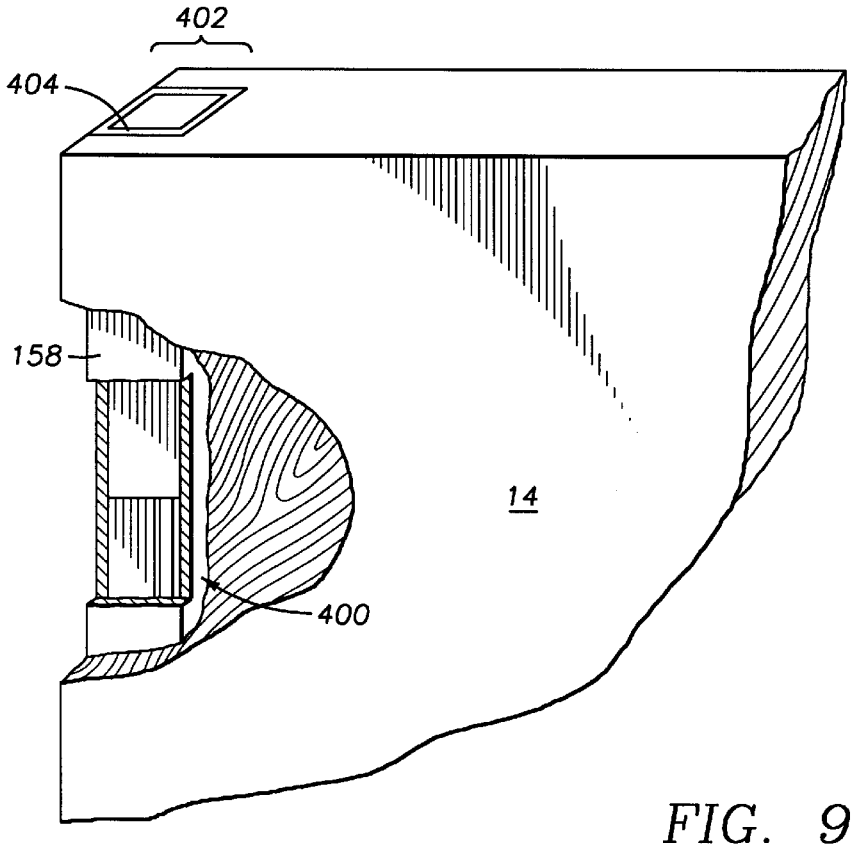
FIG. 9 is a transverse section through a door having a channel and flush bolt mounted therein.

Referring now to FIG. 9, a guide channel 400, having the flush bolts 158 movably housed therein, is recessed into a rabbet 402 formed inward the outer edge of the doors 12, 14. The flush bolts 158 are inserted through the guide channels 400. Preferably, the guide channels 400 are of sufficient length to abut/engage the lock mechanism and extend above and below therefrom (to the) ends of the doors 12, 14. The guide channels 400 serve as tracks to direct the flush bolts 158 through movement between extended and retracted positions. The guide channels 400 can be used with doors 12, 14 made of various materials including but not limited to wood and metal. The guide channels 400 are preferably made of a decorative material such as brass or copper. However, the guide channels 400 may be made of plastic materials or wood may also be used.

To assemble the guide channels into the doors, a groove, such as a rabbet 402 is formed inward of the outer edge of the doors 12, 14. The guide channels 400 are installed in rabbet 402 with outer edge 404 flush with outer edge of doors 12,14. The flush bolts 158 are inserted through the guide channels 400 and connected to locks 52, 54 previously assembled in doors 12, 14. The employment of the guide channels 400 insures smooth running of the hardware within the doors and eliminates the need for a top plate or bottom plate to align the bolt at the top or bottom end of the door. The outer edges 404 of guide channels 400 form a decorative edge to hide the flush bolts 158 from normal view.

In cross section, the guide channels 400 may be rectangular, square, round, or triangular. Preferably, the interior configuration of the guide channels must be substantially similar to the outer profile of the flush bolts 158 so that the flush bolts 158 are able to accomplish slidable movement therein.

From the foregoing description, it should be appreciated that the lock system 10 of the present invention provides anti-jimmying features in a three-way single door lock. Although a preferred embodiment of the invention for use in a pair of french doors has been shown and described, it will be appreciated that the components may be used singly, or together, in single or other multiple door arrangements to provide positive locking features. The lock may be used with sliding doors to lock upper and lower flush bolts into the frame to prevent sliding. As the door approaches closure, the fingers 212 will actuate inward to release the bolts. Additionally, other lock or handle configurations may be used in conjunction with the lock elements to practice the invention, and the deadbolt and flush bolt features of the invention used separately or in any combination thereof.

I claim:

1. A method of locking and unlocking a self-locking latch bolt which is biased in an extended position from an enclosure cover, comprising:

extending a locking plate linearly to hold the self-locking latch bolt in the extended position in response to an inward force applied to one or more flush bolt retainers;

pivoting a lockout member within the cover in response to extending the locking plate to selectively lock the latch bolt in the extended position; and releasing the lockout member by rotating a handle to retract the locking plate.

2. The method of claim 1, wherein:

the locking plate engages the rotatable handle and a latch plate which is slidably connected to the locking plate;

the lockout member freely pivots in response to movement of the locking plate; and the lockout member selectively blocks movement of the latch plate.

3. The method of claim 1, further comprising:

retracting one or more flush bolts located external of the cover in response to rotating the handle to retract the locking plate; and extending the one or more flush bolt retainers from within the cover in response to retracting the flush bolts to selectively lock the flush bolts in a retracted position.

4. A method of operating a multi-point cylindrical lock having a rotatable handle which is operatively connected to a latch bolt which is biased in an extended position from an enclosure cover, comprising:

retracting the latch bolt and one or more flush bolts located external of the cover by turning the rotatable handle;

extending one or more flush bolt retainers from within the cover in response to retracting the flush bolts to lock the flush bolts in a retracted position;

releasing the latch bolt and the one or more flush bolts by applying an inward directed force to the one or more flush bolt retainers to move the retainers inwardly of the cover;

moving a lockout member within the cover by applying the inward directed force to the one or more flush bolt retainers to selectively lock the latch bolt in the extended position; and unlocking the latch bolt by rotating the handle.

5. The method of claim 4, wherein the latch bolt is locked in the extended position by a locking plate which is biased linearly to hold the latch bolt in the extended position and which is operatively connected to the rotatable handle and the lockout member to retract the locking plate in response to the turning of the rotatable handle.

6. The method of claim 5, wherein the lockout member which secures the latch bolt is released by rotating the handle to retract the locking plate.

7. The method of claim 6, wherein:

the locking plate engages the rotatable handle and a latch plate which is slidably connected to the locking plate;

the lockout member freely pivots in response to movement of the locking plate; and the lockout member selectively blocks movement of the latch plate.

8. The method of claim 7, wherein the lockout member is constrained in a slot in the locking plate when the latch bolt is locked in the extended position.

9. The method of claim 7, wherein the lockout member is pivotally connected to the enclosure cover.

10. The method of claim 4, wherein the latch bolt is a self-locking latch bolt.

* * * * *

UNITED STATES PATENT AND TRADEMARK OFFICE

CERTIFICATE OF CORRECTION

PATENT NO. : 5,820,173

DATED : October 13, 1998

INVENTOR(S) : Mark Weston Fuller

It is certified that error appears in the above-identified patent and that said Letters Patent is hereby corrected as shown below:

In column 1, line 41, replace "Bach" with --Each--.

Signed and Sealed this

Twentieth Day of July, 1999

*Attest:*

*Attesting Officer*

Q. TODD DICKINSON

*Acting Commissioner of Patents and Trademarks*